US010265985B2

(12) United States Patent
Horn

(10) Patent No.: US 10,265,985 B2
(45) Date of Patent: Apr. 23, 2019

(54) HEAT-SENSITIVE RECORDING MATERIAL

(71) Applicant: PAPIERFABRIK AUGUST KOEHLER SE, Oberkirch (DE)

(72) Inventor: Michael Horn, Offenburg (DE)

(73) Assignee: PAPIERFABRIK AUGUST KOEHLER SE, Oberkirch (DE)

( * ) Notice: Subject to any disclaimer, the term of this patent is extended or adjusted under 35 U.S.C. 154(b) by 0 days.

(21) Appl. No.: 15/560,060

(22) PCT Filed: Mar. 7, 2016

(86) PCT No.: PCT/DE2016/100101

§ 371 (c)(1),
(2) Date: Sep. 20, 2017

(87) PCT Pub. No.: WO2016/150428

PCT Pub. Date: Sep. 29, 2016

(65) Prior Publication Data

US 2018/0079243 A1 Mar. 22, 2018

(30) Foreign Application Priority Data

Mar. 23, 2015 (DE) ..... 10 2015 104 306

(51) Int. Cl.
*B41M 5/333* (2006.01)
*B41M 5/327* (2006.01)
*B41M 5/337* (2006.01)

(52) U.S. Cl.
CPC ..... *B41M 5/3333* (2013.01); *B41M 5/3275* (2013.01); *B41M 5/3375* (2013.01); *B41M 5/3377* (2013.01)

(58) Field of Classification Search
CPC .... B41M 5/327; B41M 5/3275; B41M 5/333; B41M 5/3333; B41M 5/337; B41M 5/3375; B41M 5/3377; B41M 2205/04
USPC ..... 503/216, 217
See application file for complete search history.

(56) References Cited

U.S. PATENT DOCUMENTS

| | | | |
|---|---|---|---|
| 6,329,116 | B1 | 12/2001 | Sato et al. |
| 6,746,718 | B2 | 6/2004 | Yokota |
| 9,518,011 | B2 | 12/2016 | Sakai et al. |

FOREIGN PATENT DOCUMENTS

| | | | |
|---|---|---|---|
| DE | 10196052 | T1 | 2/2003 |
| EP | 0620122 | B1 | 3/1996 |
| JP | 2000229970 | A | 8/2000 |
| JP | 2000355172 | A | 12/2000 |
| JP | 2001071647 | A | 3/2001 |
| JP | 2006068961 | A | 3/2006 |
| WO | 0035679 | A1 | 6/2000 |
| WO | 2014080615 | A1 | 5/2014 |

OTHER PUBLICATIONS

International Search Report for PCT/DE2016/100101.

*Primary Examiner* — Bruce H Hess
(74) *Attorney, Agent, or Firm* — Fay Sharpe LLP

(57) ABSTRACT

The invention relates to a heat-sensitive recording material, comprising a supporting substrate and a heat-sensitive color-forming layer, which contains at least one color former and at least one phenol-free color developer, characterized in that the at least one color developer is a compound of formula (I), wherein Ar is an aryl residue, a heteroaryl residue, or a benzyl residue and Y is an aryl residue, a heteroaryl residue, a benzyl residue, an aryloxy residue, a heteroaryloxy residue, a benzyloxy residue, an arylamino residue, a heteroarylamino residue, or a benzylamino residue. The invention further relates to a method for producing said heat-sensitive recording material.

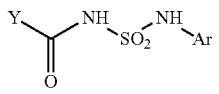

(I)

21 Claims, No Drawings

HEAT-SENSITIVE RECORDING MATERIAL

The invention relates to a heat-sensitive recording material, comprising a carrier substrate and a heat-sensitive colour-forming layer, which contains at least one colour former and at least one phenol-free colour developer, a method for producing said heat-sensitive recording material, and the use of the phenol-free colour developer contained in the heat-sensitive recording material.

Heat-sensitive recording materials for direct thermal printing which have a heat-sensitive colour-forming layer (thermal reaction layer) applied to a carrier substrate have long been known. A colour former and a colour developer are usually present in the heat-sensitive colour-forming layer and react with one another under the action of heat and thus lead to a development of colour. Heat-sensitive recording materials which contain a non-phenolic colour developer in the heat-sensitive colour-forming layer are also known. These were developed in order to improve the stability of the printed text, especially even if the printed heat-sensitive recording material is stored over a longer period of time or comes into contact with hydrophobic substances, such as plasticiser-containing materials or oils. Especially against the background of public discussions regarding the toxic potential of (bis)phenol chemicals, the interest in non-phenolic colour developers has significantly increased. Here, the aim was to avoid the disadvantages of the phenolic colour developers, although the performance properties that can be attained with phenolic colour developers should at least be maintained.

EP 0 620 122 B1 discloses non-phenolic colour developers from the class of aromatic sulfonyl ureas. These can be used to obtain heat-sensitive recording materials that are characterised by a high image stability. The heat-sensitive recording materials based on these colour developers also have a useful thermal sensitivity with good surface whiteness, so that, with corresponding composition of the formulation of the heat-sensitive colour-forming layer, it is relatively easy to produce high print densities with use of commercially available thermal printers. In practice, N,N'-[methylenebis(4,1-phenyleneiminocarbonyl)]bis[4-methylbenzenesulfonamide] (B-TUM) has established itself.

WO 00/35679 A1 discloses aromatic and heteroaromatic sulfonyl(thio)urea compounds (X=S or O) and/or sulfonyl guanidines (X=NH) of formula

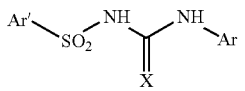

wherein Ar is linked by a bivalent linker group to further aromatic groups. A non-phenolic developer from this class that is widespread in practice, 4-methyl-N-[[[3-[[(4-methylphenyl)sulfonyl]oxy]phenyl]amino]carbonyl]benzenesulfonamide (trade name Pergafast 201®, BASF), is characterised by the balance of the application-related properties of the heat-sensitive recording materials produced with this developer substance. Especially, they have a good dynamic response sensitivity and a high resistance of the print to hydrophobic substances.

Furthermore, WO 2014/080615 A1 discloses developer substances with urea and sulfonamide substructures which, besides a good dynamic sensitivity and background whiteness, can ensure a stability of the colour complex sufficient for many applications.

A feature common to all non-phenolic developer substances of the prior art is a greater structural complexity of the molecules compared to the (bis)phenol developer substances. This generally requires a multi-step synthesis at the time of production and the need for the use of a greater number of raw materials that are often costly. All of these factors have a negative effect on the production costs and the price of such substances and prevent the use of such materials on a wide basis.

There is thus an increasing need for economically producible, non-phenolic colour developers with balanced performance profile. The colour developers of the prior art cannot satisfy both requirements at the same time.

With regard to the durability aspect, primary importance is attached to the following factors in the case of heat-sensitive recording materials:

a) the stability of the unprinted ("white") heat-sensitive recording material with prolonged storage and/or under adverse climatic conditions, especially with regard to the retention of the specified values of the dynamic response sensitivity and whiteness, and b) the stability of the printed writing generated by the thermal printing process, which printed writing especially should withstand the (also prolonged) effect of temperature, atmospheric oxygen, light, moisture, hydrophobic agents, etc. (storage capability).

Whereas the requirements cited under a) relate to the stability or constancy of the composition of the heat-sensitive colour-forming layer, especially the chemical stability of the colour-forming components, even with prolonged storage and under adverse climatic conditions, the requirements cited under b) are targeted towards the stability of the colour complex forming in the heat-sensitive colour-forming layer during the printing process.

The above-mentioned heat-sensitive recording materials with colour developers based on sulfonyl ureas indeed meet the requirements cited under b), but nevertheless present weaknesses with regard to the requirements cited under a). Specifically, the sulfonyl ureas are chemically unstable, especially in the presence of water. This tendency for decomposition of the sulfonyl ureas over a wide pH range is known and has been well documented (A. K. Sarmah, 3. Sabadie, 3. Agric. Food Chem., 50, 6253 (2002)).

The problem addressed by the present invention is therefore to overcome the above-presented disadvantages of the prior art. Especially, the problem addressed by the present invention lies in providing a heat-sensitive recording material which uses non-phenolic colour developers producible economically from easily accessible raw materials and partly by one-step syntheses. The heat-sensitive recording material should demonstrate a balanced application-related property profile and should achieve at least the performances of the heat-sensitive recording materials based on known non-phenolic colour developers, especially based on sulfonyl ureas. The requirements cited above under a), that is to say the functional properties necessary for the particular application, such as thermal response sensitivity and surface whiteness, should also be met, more specifically even with storage over longer periods of time and under adverse climatic conditions. This last partial problem therefore concerns the property profile of an unprinted heat-sensitive recording material.

Especially, the problem addressed by the present invention thus lies in providing a heat-sensitive recording material based on economical colour developers which can be easily synthesised, wherein this heat-sensitive recording material should also have a balanced performance ratio in relation to various properties, especially such as background whiteness, optical density, static starting point, artificial ageing, and stability of the printed image.

This problem is addressed in accordance with the invention by a heat-sensitive recording material according to claim 1, in accordance with which said heat-sensitive recording material comprises a carrier substrate and a heat-sensitive colour-forming layer containing at least one colour former and at least one phenol-free colour developer, and characterised in that the at least one colour developer is a compound of formula (I)

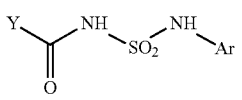

(I)

wherein Ar is an aryl group, a heteroaryl group or a benzyl group and Y is an aryl group, a heteroaryl group, a benzyl group, an aryloxy group, a heteroaryloxy group, a benzyloxy group, an arylamino group, a heteroarylamino group or a benzylamino group.

An aryl group is understood to mean a monovalent atom group which derives from aromatic hydrocarbons by removal of a hydrogen atom bound to the ring.

A heteroaryl group is understood to mean a monovalent atom group which derives from heteroaromatic hydrocarbons by removal of a hydrogen atom bound to the ring.

A benzyl group is understood to be a $—CH_2—C_6H_5$ group.

An aryloxy group (Ar—O) is understood to mean a monovalent atom group in which an aryl group is bound via an oxygen atom to a molecule.

A heteroaryloxy group is understood to mean a monovalent atom group in which a heteroaryl group is bound via an oxygen atom to a molecule.

A benzyloxy group is understood to mean a $—OCH_2—C_6H_5$ group.

An arylamino group (Ar—NH) is understood to mean a monovalent atom group in which an aryl group is bound via an NH group via the nitrogen to a molecule.

A heteroarylamino group is understood to mean a monovalent atom group in which a heteroaryl group is bound via an NH group via the nitrogen to a molecule.

A benzylamino group is understood to mean a $—NHCH_2—C_6H_5$ group.

Ar can be unsubstituted or substituted. The substitution can be single or multiple. The substituents can be the same or different.

Especially preferred substituents of Ar and/or Y are selected from the group comprising $C_1$-$C_5$ alkyl, preferably methyl and ethyl groups, $C_2$-$C_5$ alkenyl, $C_2$-$C_5$ alkinyl, alkoxy (RO), halide, carboxyl (ROCO), cyanide, $Ar_1—O_2SO$, nitro and/or —NH—CO—NH—$Ar_1$ groups, wherein R is a $C_1$-$C_5$ alkyl, preferably a methyl and/or ethyl group, a $C_2$-$C_5$ alkenyl, a $C_2$-$C_5$ alkinyl or a phenyl group, and wherein $Ar_1$ is an aromatic group, preferably a phenyl group, which optionally is substituted with one or more $C_1$-$C_5$ alkyl, preferably methyl and/or ethyl groups, $C_2$-$C_5$ alkenyl, and/or $C_2$-$C_5$ alkinyl groups.

Especially preferred substituents are $C_1$-$C_5$ alkyl, carboxyl, nitro and/or —NH—CO—NH—$Ar_1$ groups.

In an especially preferred embodiment, Ar is an aryl group, especially a phenyl or 1- or 2-naphthyl group.

In a further especially preferred embodiment, Y is an aryl group, especially a phenyl, a 1- or a 2-naphthyl group, or an arylamino group, especially a phenylamino or a naphthylamino group.

In a very especially preferred embodiment, Ar is a phenyl group and Y is a phenyl or a phenylamino group.

In a further very especially preferred embodiment, Ar is a 4-methoxycarbonylphenyl group and Y is a phenyl or a phenylamino group.

Especially preferred embodiments, the colour developer of the heat-sensitive recording material according to the invention is selected from the group consisting of N-phenyl-N'[(phenylamino)sulfonyl]urea, N-(4-methylphenyl)-N'[(4-methylphenylamino)sulfonyl]urea, N-(4-ethoxycarbonylphenyl)-N'[(4-ethoxycarbonylphenylamino)sulfonyl]urea, N-(1-naphthyl)-N'[(1-naphthylamino)sulfonyl]urea, N-[(phenylamino)sulfonyl]benzamide, N-[(4-methoxycarbonylphenyl)aminosulfonyl]benzamide, N-({2-[(phenylcarbamoyl)amino]phenyl}sulfamoyl)benzamide, N-[(4-nitrophenyl)aminosulfonyl]benzamide and/or N-[2-[[(phenylamino)carbonyl]amino]phenyl] benzenesulfonamide.

The compounds of formula I can be produced in accordance with known methods. Reference is made by way of example to DE 931225/1952, DE 940292/1952 and DE940529/1952.

Preferably, approximately 0.5 to approximately 10 parts by weight, preferably approximately 1.5 to approximately 4 parts by weight, of the compound of formula (I) are present, based on 1 part by weight of colour former. Amounts below 0.5 parts by weight have the disadvantage that the desired thermal print sensitivity is not reached, whereas amounts of more than 10 parts by weight are detrimental to the economical efficiency of the recording material, without obtaining any improvements in terms of the particular application.

The compound of formula (I) is preferably present in an amount of from approximately 3 to approximately 35% by weight, especially preferably in an amount of from approximately 10 to approximately 25% by weight, based on the total solids content of the heat-sensitive layer.

The selection of the carrier substrate is not critical. However, it is preferred to use paper, synthetic paper and/or a plastics film as carrier substrate. At least one further intermediate layer is provided optionally between the carrier substrate and the heat-sensitive layer. At least one protective layer and/or at least one layer promoting the printability can also be present in the heat-sensitive recording material according to the invention, wherein these layers are applied to the front or rear side of the substrate.

With regard to the choice of the colour former, the present invention is also not subject to any substantial restrictions. However, the colour former is preferably a dye of the triphenylmethane type, of the fluoran type, of the azaphthalide type and/or of the fluorene type. A very especially preferred colour former is a dye of the fluoran type, since it makes it possible to provide a recording material having an attractive price: performance ratio thanks to the availability and balanced application-related properties.

Especially preferred dyes of the fluoran type are:
3-diethylamino-6-methyl-7-anilinofluoran,
3-(N-ethyl-N-p-toludinamino)-6-methyl-7-anilinofluoran,
3-(N-ethyl-N-isoamylamino)-6-methyl-7-anilinofluoran,
3-diethylamino-6-methyl-7-(o,p-dimethylanilino)fluoran,
3-pyrrolidino-6-methyl-7-anilinofluoran,
3-(cyclohexyl-N-methylamino)-6-methyl-7-anilinofluoran,
3-diethylamino-7-(m-trifluoromethylanilino)fluoran,
3-N-n-dibutylamino-6-methyl-7-anilinofluoran, 3-diethylamino-6-methyl-7-(m-methylanilino)fluoran,
3-N-n-dibutylamino-7-(o-chloroanilino)fluoran,
3-(N-ethyl-N-tetrahydrofurfurylamino)-6-methyl-7-anilinofluoran,
3-(N-methyl-N-propylamino)-6-methyl-7-anilinofluoran,
3-(N-ethyl-N-ethoxypropylamino)-6-methyl-7-anilinofluoran,
3-(N-ethyl-N-isobutylamino)-6-methyl-7-anilinofluoran and/or
3-dipentylamino-6-methyl-7-anilinofluoran.

The colour formers can be used individually or also as mixtures of two or more colour formers, provided the desired application-related properties of the recording materials do not suffer as a result.

In an especially preferred embodiment, at least two compounds falling under the formula I are present as colour developers. Likewise, one or more further (bis)phenol or non-phenolic colour developers can be present in the heat-sensitive colour-forming layer in addition to the compound or compounds of formula I.

The one or more further non-phenolic colour developer(s) is/are preferably 4-methyl-N-[[[3-[[(4-methylphenyl)sulfonyl]oxy]phenyl]amino]carbonyl]-benzenesulfonamide or N-[2-[[(phenylamino)carbonyl]amino]phenyl]-benzenesulfonamide.

Besides the at least one colour former and the at least one colour developer, one or more sensitising layer(s) (also thermal solvent) can be present in the heat-sensitive colour-forming layer, which has the advantage that the thermal print sensitivity can be more easily controlled.

Generally, substances of which the melting point lies between approximately 90 and approximately 150° C. and which in the molten state dissolve the colour-forming components (colour former and colour developer) without disturbing the formation of the colour complex are advantageously considered as sensitising agents.

The sensitising agent is preferably a fatty acid amide, such as stearamide, behenamide or palmitamide, an ethylene-bis-fatty acid amide, such as N,N'-ethylene-bis-stearic acid amide or N,N'-ethylene-bis-oleic acid amide, a wax, such as polyethylene wax or montan wax, a carboxylic acid ester, such as dimethyl terephthalate, dibenzyl terephthalate, benzyl-p-benzyloxybenzoate, di-(p-methylbenzyl)-oxalate, di-(p-chlorobenzyl)oxalate or di-(p-benzyl)oxalate, an aromatic ether, such as 1,2-diphenoxyethane, 1,2-di-(3-methylphenoxy)ethane, 2-benzyloxynaphthalene or 1,4-diethoxynaphthalene, an aromatic sulfone, such as diphenyl sulfone, and/or an aromatic sulfonamide, such as benzenesulfonanilide or N-benzyl-p-toluenesulfonamide.

In a further preferred embodiment, besides the colour former, the phenol-free colour developer and the sensitising agent, there is also at least one stabiliser (anti-ageing means) present in the heat-sensitive colour-forming layer.

The stabiliser is preferably constituted by sterically hindered phenols, especially preferably by 1,1,3-tris-(2-methyl-4-hydroxy-5-cyclohexyl-phenyl)butane, 1,1,3-tris-(2-methyl-4-hydroxy-5-tert-butylphenyl)butane, or 1,1-bis-(2-methyl-4-hydroxy-5-tert-butyl-phenyl)butane.

Urea-urethane compounds of general formula (II), the trade product UU (urea-urethane), or ethers derived from 4,4'-dihydroxydiphenyl sulfone, such as 4-benzyloxy-4'-(2-methylglycidyloxy)diphenyl sulfone (trade name NTZ-95®, Nippon Soda Co. Ltd.), or oligomeric ethers of general formula (III) (trade name D90®, Nippon Soda Co. Ltd.) can be used as stabilisers in the recording material according to the invention.

(II)

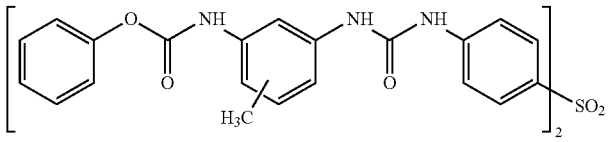

(III)

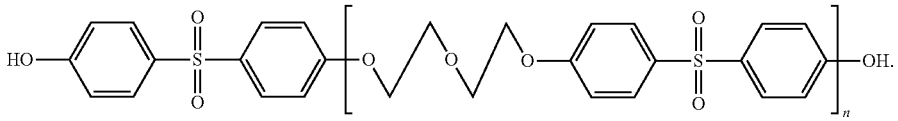

The urea-urethane compounds of general formula (II) are especially preferred.

The stabiliser is preferably present in an amount of from 0.2 to 0.5 parts by weight, based on the at least one phenol-free colour developer of the compound of formula (I).

In a further preferred embodiment, at least one binder is present in the heat-sensitive colour-forming layer. This binder is preferably constituted by water-soluble starches, starch derivatives, starch-based biolatices of the Eco-Sphere® type, methylcellulose, hydroxyethylcellulose, carboxymethylcelluloses, partially or fully saponified polyvinyl alcohols, chemically modified polyvinyl alcohols or styrene-maleic acid anhydride copolymers, styrene-butadiene copolymers, acrylamide-(meth)-acrylate copolymers, acrylamide-acrylate-methacrylate-terpolymers, polyacrylates, poly (meth)acrylic acid esters, acrylate-butadiene-copolymers, polyvinyl acetates and/or acrylonitrile-butadiene-copolymers.

In a further preferred embodiment, at least one release agent (anti-stick agent) or lubricant is present in the heat-sensitive colour-forming layer. Such agents are preferably fatty acid metal salts, such as zinc stearate or calcium stearate, or behenate salts, synthetic waxes, for example in the form of fatty acid amides, such as stearic acid amide and behenic acid amide, fatty acid alkanolamides, such as stearic acid methylolamide, paraffin waxes having different melting points, ester waxes having different molecular weights, ethylene waxes, propylene waxes having different degrees of hardness and/or natural waxes, such as carnauba wax or montan wax.

In a further preferred embodiment, the heat-sensitive colour-forming layer contains pigments. The use of pigments has the advantage inter a/ia that they are able to fix on their surface the chemical melts formed in the thermal printing process. The surface-whiteness and opacity of the heat-sensitive colour-forming layer and the printability thereof with conventional printing inks can also be controlled by means of pigments. Finally, pigments have an "extender function", for example for the relatively costly colour-imparting functional chemicals.

Especially suitable pigments are inorganic pigments, of both synthetic and natural origin, preferably clays, precipitated or natural calcium carbonates, aluminium oxides, aluminium hydroxides, silicic acids, precipitated and pyrogenic silicic acids (for example Aerodisp® types) diatomaceous earths, magnesium carbonates, talcum, and also organic pigments, such as hollow pigments having a styrene/acrylate copolymer wall or urea/formaldehyde condensation polymers. These can be used alone or in any mixtures.

To control the surface-whiteness of the heat-sensitive recording material according to the invention it is possible to incorporate optical brighteners into the heat-sensitive colour-forming layer. These are preferably stilbenes.

In order to improve certain coating-related properties it is preferred in individual cases to add further constituents, especially rheology aids, such as thickeners and/or surfactants, to the mandatory constituents of the heat-sensitive recording material according to the invention.

The application weight per unit area of the (dry) heat-sensitive layer is preferably from approximately 1 to approximately 10 g/m$^2$, preferably from approximately 3 to approximately 6 g/m$^2$.

In an especially preferred embodiment, the heat-sensitive recording material is a material according to claim 2, wherein a dye of the fluoran type is used as colour former and, in addition, a sensitising agent selected from the group consisting of fatty acid amides, aromatic sulfones and/or aromatic ethers is present. In this preferred embodiment it is also advantageous for there to be present from approximately 1.5 to approximately 4 parts by weight of the phenol-free colour developer according to claim 2, based on the colour former.

The heat-sensitive recording material according to the invention can be obtained using known production methods.

It is preferable, however, to obtain the recording material according to the invention using a method in which an aqueous suspension containing the starting materials of the heat-sensitive colour-forming layer is applied to a carrier substrate and dried, wherein the aqueous application suspension has a solids content of from approximately 20 to approximately 75% by weight, preferably from approximately 30 to approximately 50% by weight, and is applied using the curtain coating method at an operating speed of the coating apparatus of at least approximately 400 m/min and dried.

This method is especially advantageous from economical viewpoints.

If the solids content falls below a value of approximately 20% by weight, economical efficiency is impaired because a large amount of water has to be removed from the coating in a short time by gentle drying, which has an adverse effect on the coating speed. If, on the other hand, the solids content exceeds a value of 75% by weight, this results merely in an increase in technical outlay in order to ensure the stability of the coating colour curtain during the coating process.

As mentioned above, it is advantageous to produce the heat-sensitive recording material according to the invention by means of a method in which the aqueous application suspension is applied using the curtain coating method at an operating speed of the coating apparatus of at least approximately 400 m/min. What is known as the curtain coating method is known to the person skilled in the art and is distinguished by the following criteria:

In the curtain coating method, a free-falling curtain of a coating dispersion is formed. By falling freely, the coating dispersion, which is in the form of a thin film (curtain), is "poured" onto a substrate in order to apply the coating dispersion to the substrate. DE 10196052 T1 discloses the use of the curtain coating method for the production of information recording materials including inter alia heat-sensitive recording materials, with multi-layer recording layers being obtained by application of the curtain, which comprises a plurality of coating dispersion films, to substrates (max. speed 200 m/min).

The adjustment of the operating speed of the coating apparatus to at least approximately 400 m/min has both economical and technical advantages. The operating speed is especially preferably at least approximately 750 m/min, very especially preferably at least approximately 1000 m/min and very especially preferably at least approximately 1500 m/min. It was especially surprising that even at the last-mentioned speed the heat-sensitive recording material obtained is in no way impaired and that operation proceeds in an optimum way even at such a high speed.

In a preferred embodiment of the method according to the invention, the aqueous deaerated application suspension has a viscosity of from approximately 150 to approximately 800 mPas (Brookfield, 100 rev/min, 20° C.). If the viscosity falls below a value of approximately 150 mPas or exceeds a value of approximately 800 mPas, this results in insufficient runnability of the coating composition at the coating apparatus. The viscosity of the aqueous deaerated application suspension is especially preferably from approximately 200 to approximately 500 mPas.

In a preferred embodiment, to optimise the method the surface tension of the aqueous application suspension can be adjusted to from approximately 25 to approximately 60 mN/m, preferably to from approximately 35 to approximately 50 mN/m (measured in accordance with the static ring method according to Du Noüy, DIN 53914).

The heat-sensitive colour-forming layer can be formed online or in a separate coating operation offline. This also applies to any subsequently applied layers or intermediate layers.

It is advantageous for the dried heat-sensitive colour-forming layer to be subjected to a smoothing step. The surface of the recording material is preferably smoothed with a shoe calender according to DE 10 2004 029 261 B4. Here, it is advantageous to adjust the Bekk smoothness, measured according to ISO 5627, to from approximately 100 to approximately 1000 sec, preferably to from approximately 250 to approximately 600 sec.

The surface roughness (PPS) according to ISO 8791-4 lies preferably in the range from approximately 0.50 to approximately 2.50 μm, especially preferably between 1.00 and 2.00 μm.

The preferred embodiments listed in connection with the heat-sensitive recording material likewise apply to the method according to the invention.

The present invention relates also to a heat-sensitive recording material which is obtainable using the method described above.

The method presented above is advantageous from economical viewpoints and allows the coating system to operate at high speeds, even at speeds of more than 1500 m/min, without detriment to the method product, i.e. the heat-sensitive recording material according to the invention. The method can be performed online and offline, which results in flexibility, which is desirable.

The heat-sensitive recording material according to the invention is phenol-free, and is well suited for POS (point-of-sale) and/or labelling applications. It is also suitable for the production of parking tickets, travel tickets, entry tickets, lottery tickets and betting slips etc. which can be printed using direct thermal processes and ensures a high degree of stability of the images recorded thereon with prolonged storage, even under adverse climatic conditions in respect of temperature and ambient humidity, and in the event of the printed writing coming into contact with hydrophobic substances, such as plasticisers, or fatty or oily substances, etc.

The invention will be explained in detail hereinafter on the basis of non-limited examples.

EXAMPLES

On a laboratory scale, an aqueous application suspension for forming the heat-sensitive colour-forming layer of a heat-sensitive recording paper was applied by means of a doctor bar to one side of a synthetic base paper (Yupo® FP680) of 63 g/m$^2$ (coating formulations R1, R2) or of a paper of 45 g/m$^2$ carrying a pre-coating (coating formulations R3 to R11), wherein the pre-coating was formulated with organic hollow bead pigments (of the Ropaque™ type). Once dried, a thermal recording sheet was obtained. The applied amount of the heat-sensitive colour-forming layer was between 4.0 and 4.5 g/m$^2$.

On a production scale, the application of the aqueous application suspension to a paper web having a weight per unit area of 43 g/m$^2$ was carried out by means of the curtain coating method. The viscosity of the aqueous application suspension was 450 mPas (according to Brookfield, 100 rev/min, 20° C.) (in the deaerated state). The surface tension thereof was 46 mN/m (statistical ring method). The coating apparatus was arranged inline. The curtain coating method was operated at a speed of 1550 m/min.

After the application of the aqueous application suspension, the operation of drying the coated paper carrier was carried out in the customary way. The application weight per unit area of the dry heat-sensitive layer was 4.0-4.5 g/m$^2$.

A heat-sensitive recording material or thermal paper was produced on the basis of the details given above, wherein the following formulations of aqueous application suspensions were used to form a composite structure on a carrier substrate and then the further layers, especially a protective layer, were formed in the customary way, which will not be discussed separately here.

Production of the Dispersions (in Each Case for 1 Part by Weight) for the Application Suspensions:

The aqueous dispersion A1 (colour former dispersion) is produced by grinding 20 parts by weight of 3-N-n-dibutylamino-6-methyl-7-anilinofluoran (ODB-2) with 33 parts by weight of a 15% aqueous solution of Ghosenex™ L-3266 (sulfonated polyvinyl alcohol, Nippon Ghosei) in a bead mill.

The aqueous dispersion A2 (2-component colour former dispersion) is a mixture of two colour formers, which was produced by mixing a first dispersion, which was produced by grinding 12 parts by weight of 3-N-n-dibutylamino-6-methyl-7-anilinofluoran (ODB-2) with 20 parts by weight of a 15% aqueous solution of Ghosenex™ L-3266 in a bead mill, and a second dispersion, which was produced by grinding 8 parts by weight of 3-(N-ethyl-N-isopentylamino)-6-methyl-7-anilinofluoran (S-205) with 14 parts by weight of a 15% aqueous solution of Ghosenex™ L-3266 in a bead mill.

The aqueous dispersion B1 (colour developer dispersion) is produced by grinding 40 parts by weight of the colour developer together with 66 parts by weight of a 15% aqueous solution of Ghosenex™ L-3266 in the bead mill.

The aqueous dispersion B2 (2-component colour developer dispersion formed of FE I and FE II) was produced by mixing a first dispersion, which was produced by grinding 20 parts by weight of FE I with 33 parts by weight of a 15% aqueous solution of Ghosenex™ L-3266 in a bead mill, and a second colour developer dispersion, which was produced by grinding 20 parts by weight of FE II with 33 parts by weight of a 15% aqueous solution of Ghosenex™ L-3266 in a bead mill (reference is made to Tables 3 and 4 with regard to the definitions of FEI and FEII).

The aqueous dispersion B3 (2-component colour developer dispersion formed of FE I and FE II) was produced by mixing a first dispersion, which was produced by grinding 28 parts by weight of FE I with 46 parts by weight of a 15% aqueous solution of Ghosenex™ L-3266 in a bead mill, and a second colour developer dispersion, which was produced by grinding 12 parts by weight of FE II with 20 parts by weight of a 15% aqueous solution of Ghosenex™ L-3266 in a bead mill.

The aqueous dispersion C (sensitising agent dispersion) was produced by grinding 40 parts by weight of sensitising agent with 33 parts by weight of a 15% aqueous solution of Ghosenex™ L-3266 in a bead mill.

The aqueous dispersion D (anti-ageing agent or stabiliser dispersion) was produced by grinding 12.5 parts by weight of UU (urea-urethane) with 10 parts by weight of a 15% aqueous solution of Ghosenex™ L-3266 in a bead mill.

All dispersions produced by grinding have a mean particle size $D_{(4.3)}$ of 0.80-1.20 μm.

The dispersion E (lubricant dispersion) is a 20% zinc stearate dispersion, consisting of 9 parts by weight of Zn stearate, 1 part by weight of Ghosenex™ L-3266 and 40 parts by weight of water.

Pigment P1 is a 72% coating kaolin suspension (Lustra® S, BASF)

Pigment P2 is a 56% PCC dispersion (precipitated calcium carbonate)

Pigment P3 is a 56% aluminium hydroxide dispersion (Martigloss®, Albemarle Corp.)

Pigment P4 is obtained by dispersing 132 parts of a 56% aluminium hydroxide dispersion (Martigloss®, Albemarle Corp.) in 31.5 parts of a precipitated silicic acid (Sipernat® 350, Evonik).

The binder consists of a 10% aqueous polyvinyl alcohol solution (Mowiol 28-99, Kuraray Europe).

The application suspension is produced by mixing the dispersions, with stirring, in accordance with the amounts specified in Table 1 under consideration of the entry order B, E, C, D, P, A, binder, and is brought with water to a solids content of approximately 25%.

The particle size distribution of the application dispersions was measured by laser diffraction using a Coulter LS230 apparatus from Beckman Coulter.

Table 2 summarises the developers used in the example formulations.

The water-sensitive coating suspensions thus obtained were used to produce composite structures formed of paper carrier and thermal reaction layer.

TABLE 1

Summary of the formulations for the application dispersions (parts by weight)

| | R1 | R2 | R3 | R4 | R5 | R6 | R7 | R8 | R9 | R10 | R11 | R12 |
|---|---|---|---|---|---|---|---|---|---|---|---|---|
| A1 | 1 | 1 | 1 | 1 | 1 | 1 | — | — | — | 1 | — | 1 |
| A2 | — | — | — | — | — | — | 1 | 1 | 1 | — | 1 | — |
| B1 | 1 | — | 1 | 1 | 1 | 1 | 1 | 1 | 1 | — | — | — |
| B2 | — | — | — | — | — | — | — | — | — | 1 | 1 | 1 |
| B3 | — | 1 | — | — | — | — | — | — | — | — | — | — |
| C | 1 | 1 | 1 | 1 | 1 | 1 | 1 | 1 | 1 | 1 | 1 | 1 |
| D | — | — | — | — | — | 1 | — | — | — | — | — | 1 |
| E | 56 | 56 | 56 | 56 | 56 | 56 | 56 | 56 | 56 | 56 | 56 | 56 |
| P1 | 146 | 146 | — | — | — | — | — | — | — | — | — | — |
| P2 | — | — | 188 | — | — | 162 | 188 | — | — | 188 | 188 | 162 |
| P3 | — | — | — | 188 | 132 | — | — | 188 | 132 | — | — | — |
| P4 | — | — | — | — | 31.5 | — | — | — | 31.5 | — | — | — |
| Binder | 138 | — | 138 | 138 | 138 | 138 | 138 | 138 | 138 | 138 | 138 | 138 |

TABLE 2

Classification of the colour developers (FE)

| | Colour developer |
|---|---|
| FE1 | N-phenyl-N'[(phenylamino)sulfonyl]urea |
| FE2 | N-(4-methylphenyl)-N'[(4-methylphenylamino)sulfonyl]urea |
| FE3 | N-(4-ethoxycarbonylphenyl)-N'[(4-ethoxycarbonylphenylamino)sulfonyl]urea |
| FE4 | N-(1-naphthyl)-N'[(1-naphthylamino)sulfonyl]urea |
| FE5 | N-[(phenylamino)sulfonyl]benzamide |
| FE6 | N-[(4-methoxycarbonylphenyl)aminosulfonyl]benzamide |
| FE7 | N-({2-[(phenylcarbamoyl)amino]phenyl}sulfamoyl)-benzamide |
| FE8 | N-[(4-nitrophenyl)aminosulfonyl]benzamide |
| FE9* | 4-methyl-N-[[[3-[[(4-methylphenyl)sulfonyl]oxy-]phenyl]amino]carbonyl]benzenesulfonamide |
| FE10* | N-[2-[[(phenylamino)carbonyl]amino]phenyl]benzenesulfonamide |

*non-phenolic developer of the prior art

The thermal recording materials according to Tables 3, 4 and 5 were analysed as below.

(1) The paper whiteness on the coating side was determined in accordance with DIN/ISO 2470 using an Elrepho 3000 spectral photometer.

(2) Dynamic Colour Density:

The papers (6 cm wide strips) were printed thermally using the Atlantek 200 test printer (Atlantek, USA) with a Kyocera printhead of 200 dpi and 560 ohm at an applied voltage of 20.6 V and a maximum pulse width of 0.8 ms with a chequered pattern with 10 energy stages. The image density (optical density, o.d.) was measured using a Macbeth densitometer RD-914 from Gretag.

(3) Static Starting Point:

The recording material sheet was pressed against a series of thermostatically controlled dies heated to different temperatures with a press-on pressure of 0.2 kg/cm$^2$ and a contact time of 5 sec (thermal tester TP 3000QM, Maschinenfabrik Hans Rychiger AG, Steffisburg, Switzerland).

The image density (optical density) of the images thus produced was measured using a Macbeth densitometer RD-914 from Gretag.

The static starting point, according to definition, is the lowest temperature at which an optical density of 0.2 is achieved.

(4) Storage Stability of the Unprinted Material:

A sheet of recording paper is cut into three identical strips. One strip is dynamically recorded in accordance with the method of (2) and the image density is determined. The two other strips, in the unprinted (white) state, are exposed to a climate of 60° C. and 50% relative humidity for 4 weeks. After climate conditioning of the papers they are dynamically printed in accordance with the method of (2) and the image density is determined using the densitometer. The % change in the writing performance with printing of the stored specimens was calculated in accordance with the following equation (I).

$$\%\ \text{change in } o.d. = \left(\frac{\text{image density after test}}{\text{image density before test}} - 1\right) * 100 \qquad \text{(I)}$$

(5) Plasticiser Stability of the Printed Image:

A plasticiser-containing cling film (PVC film with 20-25% dioctyl adipate) was brought into contact with the sample of the thermal recording paper, which had been dynamically recorded in accordance with the method of (2), avoiding folds and inclusions of air, then rolled up into a roll and stored for 16 hours at room temperature (20-22° C.). After removal of the film, the image density (o.d.) was measured and set in relation to the corresponding image density values before the action of the plasticiser in accordance with formula (I).

(6) A strip of transparent self-adhesive tape from Tesa (#57315) was adhered to the sample of the thermal recording paper, which had been dynamically recorded in accordance with the method of (2), avoiding folds and inclusions of air. After storage at room temperature (20-22° C.), the image density (o.d.) was measured after 3 hours—through the adhesive tape—and was set in accordance with the formula (I) in relation to the similarly determined image density values of a freshly adhered specimen.

(7) Quantification of the coating components (colour former and colour developer) is effected after HPLC separation using a series 1200 HPLC apparatus from Agilent having a DAD detector.

Sample preparation: Two circular areas are cut out from the paper specimen using a punch and weighed. The paper samples are extracted with 3 ml of acetonitrile (HPLC quality) in an ultrasonic bath for 30 minutes and the extract is filtered through a PTFE syringe filter (0.45 μm).

HPLC separation of the ingredients: Using an autosampler the above extract was applied to a separating column (Zorbax Eclipse XDB-C18) and eluted using the solvent acetonitrile:THF:$H_2O$ (450:89:200 parts by weight) with an acetonitrile gradient. Quantitative analysis of the chromatograms is carried out by comparing the areas of the sample peaks assigned by means of tr times with a calibration curve determined by means of the reference specimens. The measurement error in the HPLC quantification is ±2%.

Table 3 summarises the analysis of the recording materials manufactured with synthetic paper (Yupo® FP680) as carrier; Table 4 summarises the analysis of the recording materials manufactured with a pre-coated carrier paper.

The achieved maximum image densities (o.d. max.) of the fresh paper are presented in Table 5 with the corresponding values after thermal printing of the (unprinted) stored paper over 4 weeks at 60° C. and 50% relative humidity, and also the change in paper whiteness after storage for selected specimens.

For the paper artificially aged by storage, a quantitative determination of the colour developer in the fresh and stored papers was also performed, and as control a corresponding determination of the colour former as coating component was performed, which from experience hardly changes at all over the storage period.

Changes to o.d. of s 10% are tolerable and do not impair the practical suitability of the papers. For the change in artificial ageing, a change of 15% is tolerable.

TABLE 3

Analysis of the laboratory specimen (Substrate: synthetic paper)

| | | | Background | | | % change o.d. | | | | |
|---|---|---|---|---|---|---|---|---|---|---|
| | | | whiteness | | Static starting | Artificial ageing | | | Stability of the printed image | |
| No. | Formulation | Developer | (%) | o.d. max | point (°C.) | dry | moist | light | TESA 3 h | plasticiser |
| 1 | R1 | FE1 | 88.6 | 1.29 | 85 | −2.4 | −2.3 | −11.5 | −21.1 | −5.6 |
| 2 | | FE2 | 89.0 | 1.26 | 83 | −7.9 | −6.5 | −19.0 | −22.5 | −28.0 |
| 3 | | FE3 | 88.4 | 1.35 | 85 | −7.4 | −5.3 | −12.0 | −10.3 | −4.4 |
| 4 | | FE4 | 88.4 | 1.22 | 99 | −7.6 | −13.6 | −15.3 | −17.4 | −51.5 |
| 5 | | FE5 | 88.5 | 1.05 | 86 | −1.0 | −5.7 | −31.3 | −17.7 | −54.1 |
| 6 | | FE6 | 89.9 | 1.26 | 96 | −1.7 | −3.3 | −18.9 | −12.4 | −10.2 |
| 7 | | FE7 | 87.9 | 1.25 | 86 | −2.4 | −2.4 | −22.4 | −18.9 | −22.2 |
| 8 | R2* | FE10 + FE1 | 88.2 | 1.31 | 78 | −1.6 | −1.6 | −18.3 | −26.0 | −5.3 |
| 9 | | FE5 + FE1 | 86.2 | 1.25 | 79 | −3.9 | −5.5 | −29.3 | −32.5 | −21.0 |
| 10 (Comparison) | R1 | FE9 | 88.2 | 1.29 | 77 | −2.5 | −7.1 | −18.8 | −13.2 | −3.3 |
| 11 (Comparison) | | FE10 | 88.5 | 1.31 | 83 | −1.2 | −1.9 | −20.8 | −23.6 | −4.0 |

*No. 8, FEI is FE10, FEII is FE1

No. 9 FEI is FE5, FEII is FE1

TABLE 4

Analysis of the laboratory specimen (Substrate: paper with pre-coating)

| | | | Background | | | % change of o.d. (best value after o.d. 2) | | | | |
|---|---|---|---|---|---|---|---|---|---|---|
| | | | whiteness | | Static starting | Artificial change | | | Stability of the printed image | |
| No. | Formulation | Developer | (%) | o.d. max | point (°C.) | dry | moist | light | TESA 3 h | plasticiser |
| 12 | R3 | FE1 | 87 | 1.37 | 87 | −1.0 | −16.9 | −10.2 | −29 | −9.2 |
| 13** | | FE10 | 87.5 | 1.34 | 86 | 0 | −1.6 | −11.6 | −26 | −6.1 |
| 14 | R4 | FE1 | 87.7 | 1.35 | 87 | −3.7 | −15.6 | −8.5 | −28 | −10.2 |
| 15** | | FE10 | 88 | 1.31 | 87 | 0 | −1.6 | −16.8 | −30 | −5.5 |
| 16 | R5 | FE1 | 87.4 | 1.36 | 85 | −3.1 | −14.0 | −16.1 | −27 | −6.8 |
| 17** | | FE10 | 87.8 | 1.36 | 86 | 0 | −2.2 | −19.1 | −29 | −3.0 |
| 18 | R6 | FE1 | 84.2 | 1.36 | 84 | −3.0 | −5.0 | −9.2 | −20 | −4.6 |
| 19** | | FE10 | 87.3 | 1.30 | 83 | −1.0 | 0 | −14.3 | −17 | −3.9 |
| 20 | R12 | FE1 + FE5 | 85.7 | 1.30 | 84 | −2.3 | −7.3 | −15.5 | −22 | −9.5 |
| 21 | R7 | FE1 | 85.3 | 1.37 | 84 | −3.0 | −14.8 | −12.4 | −31 | −5.8 |
| 22** | | FE10 | 86.6 | 1.32 | 80 | 0 | −1 | −19.1 | −26 | −3.9 |
| 23 | R8 | FE1 | 86.3 | 1.36 | 81 | −3.0 | −12.7 | −10.6 | −34 | −8.1 |
| 24** | | FE10 | 87.2 | 1.34 | 81 | 0 | −1.5 | −18.5 | −26 | −4.7 |
| 25 | R9 | FE1 | 86 | 1.42 | 81 | −2.1 | −11.5 | −12.5 | −27 | −4.4 |
| 26** | | FE10 | 86.9 | 1.35 | 80 | 0 | 0 | −18.7 | −25 | −3.0 |
| 27* | R11 | FE1 + FE10 | 85.5 | 1.34 | 78 | −1.0 | −1.5 | −12.2 | −25 | −4.7 |
| 28* | | FE5 + FE10 | 86.1 | 1.28 | 80 | 0 | −1.0 | −16.1 | −30 | −4.0 |
| 29* | R10 | FE1 + FE10 | 87.0 | 1.33 | 81 | 0 | −3.0 | −12.8 | −26 | −5.3 |
| 30* | | FE5 + FE10 | 87.5 | 1.29 | 86 | 0 | −2.4 | −18.9 | −27 | −3.3 |

*No. 27: FEI is FE1, FEII is FE10, No. 28: FEI is FE5, FEII is FE10, No. 29: FEI is FE1, FEII is FE10, No. 30: FEI is FE5, FEII is FE10

**Comparison

TABLE 5

Analysis of selected specimens from Table 3 after storage* in the unprinted state

| Test parameter | Specimen (no.) | 5 | 6 | 7 | 9 | 10 (comparison) | 11 (comparison) |
|---|---|---|---|---|---|---|---|
| Surface whiteness (%) | fresh | 88.5 | 89.9 | 87.9 | 88.2 | 88.2 | 88.5 |
| | 4 weeks storage | 75.3 | 83.4 | 70.0 | 69.6 | 69.7 | 76.0 |
| | % change | −14.9 | −7.6 | −20.3 | −15.5 | −20.9 | −14.1 |
| o.d. max. | fresh | 1.07 | 1.21 | 1.20 | 1.14 | 1.30 | 1.32 |
| | 4 weeks storage | 0.84 | 0.90 | 1.04 | 0.79 | 0.55 | 1.05 |
| | % change | −21.5 | −25.6 | −13.3 | −30.7 | −42.3 | −20.5 |
| FE ($mg/m^2$) | fresh | 608 | 673 | 561 | 637 | 516 | 554 |
| | 4 weeks storage | 552 | 664 | 541 | 387 | 284 | 520 |
| | % change | −9.2 | −1.3 | −3.6 | −39.2 | −45.0 | −6.1 |
| FBB ($mg/m^2$) | fresh | 308 | 300 | 294 | 337 | 329 | 301 |
| | 4 weeks storage | 307 | 310 | 280 | 319 | 307 | 295 |
| | % change | −0.3 | 3.3 | −4.8 | −5.3 | −6.7 | −2.0 |

*Ageing 60° C./50% relative humidity

The heat-sensitive recording material according to the invention demonstrates especially the following advantageous properties:

(1) The recorded image of the heat-sensitive recording materials according to the invention with the colour developers according to the invention has a maximum print density, which corresponds to the print density of the comparison specimens (maximum o.d. values from Tables 3 and 4), is stable under the conditions of artificial ageing, and hardly declines after exposure to hydrophobic agents (adhesives, plasticisers), comparably to the performance of the known non-phenolic developer substances (Tables 3 and 4).

(2) The surface whiteness of the heat-sensitive recording materials according to the invention is better or comparable to the comparison specimens with colour developers of the prior art, both in the fresh state and after storage under adverse climatic conditions (Table 5).

(3) The temperature from which a visually noticeable greying of the heat-sensitive recording materials according to the invention occurs (static starting point, Tables 3, 4) is comparable or higher than in the comparison papers, even with use of colour developer mixtures.

(4) The heat-sensitive recording material according to the invention demonstrates a slight drop in writing performance after four weeks of storage in the unprinted state under extreme storage conditions, which is comparable or better than that of the comparison papers (Table 5, o.d. max change, specimen nos. 5, 6, 7, 9 vs. 10 and 11).

(5) The reduction of the colour developer concentration in the heat-sensitive colour-forming layer of the heat-sensitive recording materials according to the invention after storage is low (specimen nos. 5, 6 and 7 from Table 5 (≤10%)) and hardly affects the writing performance. By contrast, the use of known non-phenolic developers (specimen no. 10, Table 5) leads to considerable losses of the colour developer amount in the paper and to an unacceptable low writing performance after storage.

(6) With customary anti-ageing agents, the image stability of the papers according to the invention with artificial ageing and compared to hydrophobic agents can be increased (Table 4, specimen nos. 18 and 20).

(7) Mixtures of the colour developers in the heat-sensitive recording materials according to the invention with one another or with known non-phenolic developers do not lead to any disadvantages with respect to the surface whiteness or starting temperature and can be used advantageously in order to selectively improve the performance properties and/or control the economical efficiency of the colour development system of the heat-sensitive recording material according to the invention.

(8) Especially, a heat-sensitive recording material that is of high quality in all key aspects of its application can be produced with the production method according to the invention under economically advantageous conditions.

(9) Previously, it was indeed possible to improve individual properties important for the application, however the core point of the heat-sensitive recording material according to the invention lies in optimising all important properties.

The invention claimed is:

1. A heat-sensitive recording material, comprising a carrier substrate and a heat-sensitive colour-forming layer, which contains at least one colour former and at least one phenol-free colour developer, characterised in that the at least one colour developer is a compound of formula (I)

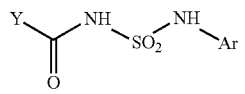

(I)

wherein Ar is an aryl group, a heteroaryl group, or a benzyl group and Y is an aryl group, a heteroaryl group, a benzyl group, an aryloxy group, a heteroaryloxy group, a benzyloxy group, an arylamino group, a heteroarylamino group, or a benzylamino group.

2. A heat-sensitive recording material according to claim 1, characterised in that Ar and/or Y contain at least one substituent.

3. A heat-sensitive recording material according to claim 2, characterised in that the at least one substituent is selected from the group comprising $C_1$-$C_5$ alkyl, a $C_2$-$C_5$ alkenyl, $C_2$-$C_5$ alkinyl, alkoxy (RO), halide, carboxyl (ROCO), cyanide, $Ar_1$—$O_2SO$, nitro, —NH—CO—NH—$Ar_1$ groups, wherein R is a $C_1$-$C_5$ alkyl, a $C_2$-$C_5$ alkenyl, a $C_2$-$C_5$ alkinyl or a phenyl group, and wherein $Ar_1$ is an aromatic group.

4. A heat-sensitive recording material according to claim 2, characterised in that the at least one substituent is selected from the group comprising $C_1$-$C_5$ alkyl, a $C_2$-$C_5$ alkenyl, $C_2$-$C_5$ alkinyl, alkoxy (RO), halide, carboxyl (ROCO), cyanide, $Ar_1$—$O_2SO$, nitro, —NH—CO—NH—$Ar_1$ groups, wherein R is a $C_1$-$C_5$ alkyl, a $C_2$-$C_5$ alkenyl, a $C_2$-$C_5$ alkinyl or a phenyl group, and wherein $Ar_1$ a phenyl group which optionally is substituted with one or more $C_1$-$C_5$ alkyl, $C_2$-$C_5$ alkenyl, and/or $C_2$-$C_5$ alkinyl groups.

5. A heat-sensitive recording material according to claim 1, characterised in that Ar is a phenyl group and Y is an arylamino group.

6. A heat-sensitive recording material according to claim 1, characterised in that Ar is a phenyl group and Y is a 4-methoxycarbonyl phenyl group.

7. A heat-sensitive recording material according to claim 1, characterised in that the phenol-free colour developer is selected from the group consisting of N-phenyl-N'[(phenylamino)sulfonyl]urea, N-(4-methylphenyl)-N'[(4-methylphenylamino)sulfonyl]-urea, N-(4-ethoxycarbonylphenyl)-N'[(4-ethoxycarbonylphenylamino)sulfonyl]-urea, N-(1-naphthyl)-N'[(1-naphthylamino)sulfonyl]-urea, N-[(phenylamino)sulfonyl]-benzamide, N-[(4-methoxycarbonylphenyl)aminosulfonyl]-benzamide, N-({2-[(phenylcarbamoyl)amino]phenyl}sulfamoyl)benzamide, N-[(4-nitrophenyl)aminosulfonyl]-benzamide and/or N-[2-[[(phenylamino)carbonyl]amino]phenyl]-benzenesulfonamide.

8. A heat-sensitive recording material according to claim 1, characterised in that the at least one colour former is a dye of the triphenylmethane type, of the fluoran type, of the azaphthalide type and/or of the fluorene type.

9. A heat-sensitive recording material according to claim 1, further comprising one or more further non-phenolic colour developers.

10. A heat-sensitive recording material according to claim 1, characterised in that at least two compounds of formula (I) are present as developer.

11. A heat-sensitive recording material according to claim 1, characterised in that approximately 0.5 to approximately 10 parts by weight of the compound of formula (I) are present, based on the colour former.

12. A heat-sensitive recording material according to claim 1, characterised in that the compound of formula (I) is present in an amount of from approximately 3 to approximately 35% by weight based on the total solids content of the heat-sensitive layer.

13. A heat-sensitive recording material according to claim 1, characterised in that the heat-sensitive colour-forming layer contains at least one of sensitising agents, stabilisers, binders, release agents, pigments and/or brighteners.

14. A heat-sensitive recording material according to claim 1, characterised in that the heat-sensitive colour-forming layer contains a urea-urethane compound of general formula (II)

(II)

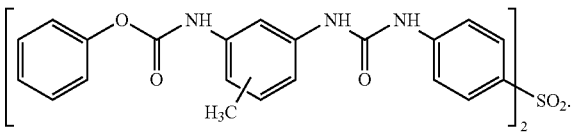

15. A method for producing a heat-sensitive recording material according to claim 1, characterised in that an aqueous suspension containing the starting materials of the heat-sensitive colour-forming layer is applied to a carrier substrate and dried, wherein the aqueous application suspension has a solids content of from approximately 20 to approximately 75% by weight, and is applied using the curtain coating method at an operating speed of the coating apparatus of at least approximately 400 m/min, and dried.

16. A heat-sensitive recording material obtainable in accordance with the method according to claim 15.

17. A heat-sensitive recording material according to claim 1, characterised in that, besides the compound of formula (I) 4-methyl-N-[[[3-[[(4-methylphenyl)sulfonyl]oxy]phenyl]amino]carbonyl]-benzenesulfonamide and/or N-[2-[[(phenylamino)carbonyl]amino]phenyl]-benzenesulfonamide is present.

18. A heat-sensitive recording material according to claim 1, characterised in that approximately 1.5 to approximately 4 parts by weight, of the compound of formula (I) are present, based on the colour former.

19. A heat-sensitive recording material according to claim 1, characterised in that the compound of formula (I) is present in an amount of from approximately 10 to approximately 25% by weight, based on the total solids content of the heat-sensitive layer.

20. A method for producing a heat-sensitive recording material according to claim 1, characterised in that an aqueous suspension containing the starting materials of the heat-sensitive colour-forming layer is applied to a carrier substrate and dried, wherein the aqueous application suspension has a solids content of from approximately 30 to approximately 50% by weight, and is applied using the curtain coating method at an operating speed of the coating apparatus of at least approximately 1500 m/min, and dried.

21. A heat-sensitive recording material according to claim 1, characterised in that the at least one colour former is a dye of the fluoran type.

* * * * *